US010751802B1

(12) United States Patent
Awad et al.

(10) Patent No.: US 10,751,802 B1
(45) Date of Patent: Aug. 25, 2020

(54) METHOD OF PRODUCING SILVER NANOPARTICLES USING RED SAND

(71) Applicant: KING SAUD UNIVERSITY, Riyadh (SA)

(72) Inventors: Manal Ahmed Gasmelseed Awad, Riyadh (SA); Moudi Abdullah Rashed Alwehaibi, Riyadh (SA); Jamilah Hamed Alshehri, Riyadh (SA); Manal Mohammed Alkhulaifi, Riyadh (SA); Noura Saleem Aldosari, Riyadh (SA); Khalid Mustafa Osman Ortashi, Riyadh (SA); Awatif Ahmed Hendi, Riyadh (SA)

(73) Assignee: King Saud University, Riyadh (SA)

( * ) Notice: Subject to any disclaimer, the term of this patent is extended or adjusted under 35 U.S.C. 154(b) by 0 days.

(21) Appl. No.: 16/592,719

(22) Filed: Oct. 3, 2019

(51) Int. Cl.

| | |
|---|---|
| ***B22F 9/16*** | (2006.01) |
| ***B22F 9/18*** | (2006.01) |
| ***B22F 9/24*** | (2006.01) |
| ***B22F 1/00*** | (2006.01) |

(52) U.S. Cl.
CPC ..... *B22F 9/16* (2013.01); *B22F 1/0018* (2013.01); *B22F 9/18* (2013.01); *B22F 9/24* (2013.01); *B22F 1/0022* (2013.01); *B22F 2301/255* (2013.01); *B22F 2304/056* (2013.01)

(58) Field of Classification Search
CPC ..... B22F 1/0018; B22F 1/0022; B22F 9/16; B22F 9/18; B22F 9/24; B22F 2301/255
USPC ..... 75/370, 371, 419–422
See application file for complete search history.

(56) References Cited

U.S. PATENT DOCUMENTS

2012/0308666 A1* 12/2012 Zielecka ..... A01N 59/16 424/618
2013/0108678 A1 5/2013 Santra

FOREIGN PATENT DOCUMENTS

CN 103642355 A 3/2014
KR 100787544 B1 12/2007

OTHER PUBLICATIONS

Shameli et al., "Synthesis of silver nanoparticles in montmorillonite and their antibacterial behavior", International Journal of Nanomedicine (2011), vol. 6, pp. 581-590.

* cited by examiner

*Primary Examiner* — Xiaobei Wang
(74) *Attorney, Agent, or Firm* — Richard C. Litman; Nath, Goldberg & Meyer

(57) ABSTRACT

The method of producing silver nanoparticles using red sand may include the steps of adding red sand to water, mixing the red sand in the water, removing a supernatant from the red sand in water mixture after the mixture has settled, adding sodium hydroxide to the supernatant to form an alkaline solution, adding silver nitrate ($AgNO_3$) to the solution, and isolating a precipitated reaction product including the silver nanoparticles. The silver nanoparticles produced according to this method have antibacterial activity, whether used alone or in combination with standard antibiotics.

6 Claims, 6 Drawing Sheets

| Bacteria | Red Sand Extract |
|---|---|
| *S. aureus* |  |
| *P. aeruginosa* |  |
| *A. baumannii* |  |
| *S. typhimurium* |  |
| *P. vulgaris* |  |
| *E. coli* |  |

METHOD OF PRODUCING SILVER NANOPARTICLES USING RED SAND

BACKGROUND OF THE INVENTION

1. Field of the Invention

The disclosure of the present patent application relates to synthesis of silver nanoparticles, and particularly to methods of synthesizing silver nanoparticles using red sand, the nanoparticles having antibacterial properties.

2. Description of the Related Art

Nanoparticles hold significant technological potential in the fields of biology, medicine and electronics owing to their unique physical and biological properties. The use naturally occurring and abundant materials for the synthesis of nanoparticles offers numerous benefits of eco-friendliness and compatibility with pharmaceutical and other biomedical applications due to the non-toxic nature of the materials involved.

Silver has very high electrical conductivity and is widely used as a conductor in circuits that require low dissipation and high conductivity. Silver paste is commonly used as a paste conductor, and particularly in conductivity characterization of bulk semiconductor materials or four-point probe method films. In the field of superconductors, silver has a dominant role as a sheath. Silver is also implicated as useful in various industries and health fields (healthcare-related products, consumer products, medical device coatings, optical sensors, cosmetics, pharmaceutical technologies, food technologies, diagnostics, orthopedics, drug delivery and antibacterial agents (particularly as an enhancer of tumor-killing effects of antibacterial drugs)). Silver has been shown to have some antibacterial properties as a catalyst.

Silver nanoparticles hold additional potential in the above-mentioned fields, particularly in biomedical fields, and particularly if they can be fabricated by methods that avoid use of expensive or toxic materials.

Red sand is an abundant resource in the area in and around Riyadh, Saudi Arabia. Although there have been attempts to use sand as at least a partial substitute for cement in recent years, currently there are no major commercial uses for red sand. Many reducing agents have been used to produce silver nanoparticles. Residual trace elements from the reducing agents may become incorporated into the nanoparticles and may affect the properties, e.g., antibacterial or antimicrobial properties, of the resulting silver nanoparticles. Thus, there is great interest in developing alternative reducing agents for producing silver nanoparticles that may be less toxic and environmentally friendly while exhibiting acceptable antibacterial activity.

Thus, a method of producing silver nanoparticles using red sand solving the aforementioned problems is desired.

SUMMARY OF THE INVENTION

A method of producing silver nanoparticles using red sand may include the steps of adding red sand to water, mixing, removing a supernatant from the red sand in water mixture, adding sodium hydroxide to the supernatant to form a solution, adding silver nitrate ($AgNO_3$) to the solution, and isolating a reaction product that comprises the silver nanoparticles. The silver nanoparticles prepared according to the presently disclosed method are useful as antibacterial agents.

These and other features of the present disclosure will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
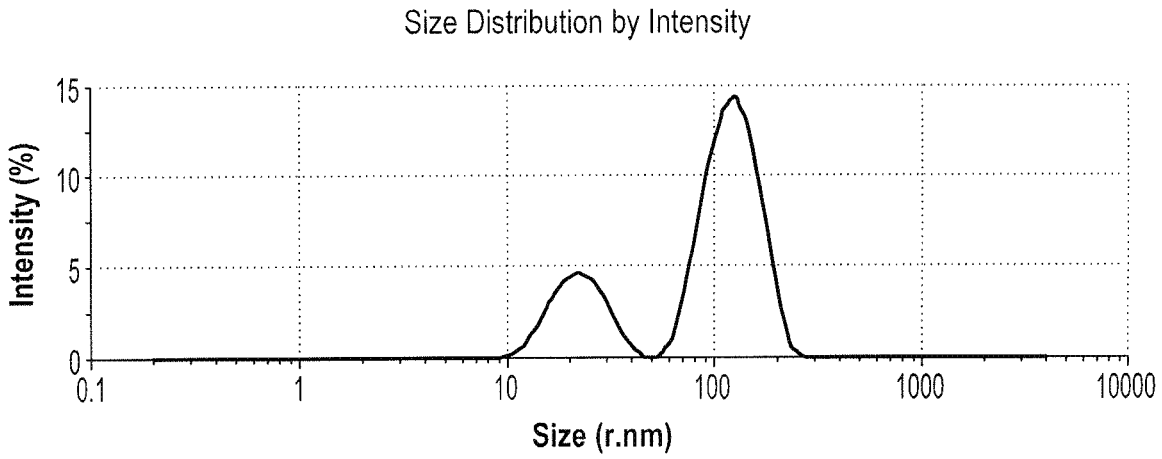
FIG. 1 is a Dynamic Light Scattering (DLS) plot of the particle size distribution of silver nanoparticles produced according to the method of producing silver nanoparticles using red sand.

The method of producing silver nanoparticles using red sand may include the steps of adding red sand to water, mixing the red sand in water, removing the supernatant from the red sand in water mixture, adding sodium hydroxide to the supernatant to form a solution, adding silver nitrate ($AgNO_3$) to the solution, and isolating a reaction product that comprises the silver nanoparticles.

The step of removing a supernatant may include allowing the sand to settle and decanting the resulting supernatant, and may further include centrifuging the resulting supernatant to obtain a final supernatant. The step of adding sodium hydroxide may be performed under stirring at a temperature of about 45° C. for about 30 minutes. The step of adding silver nitrate may include dissolving silver nitrate in water and adding the silver nitrate in water dropwise into the solution. The formation of a reaction product in the solution may be confirmed by a visual change of color to brown, presumably due to surface plasmon vibrations of the silver nanoparticles formed therein.

The present method of synthesizing silver nanoparticles may provide silver nanoparticles with predictable properties and in scalable quantities. The silver nanoparticles produced by the above method may be polydispersed in size.

The method for producing silver nanoparticles can be useful in many fields. The nanoparticles are shown to have antibacterial activities, as discussed below. As red sand is an abundant resource, the present method is particularly desirable for synthesizing silver nanoparticles.

It should be understood that the amounts of materials for the methods described herein are exemplary, and appropriate scaling of the amounts is encompassed by the present method, as long as the relative ratios of materials are maintained. As used herein, the term "about," when used to modify a numerical value, means within ten percent of that numerical value.

The term "nano", in terms of nanomaterials, refers to materials characterized as having a dimension less than 1 micron. This is in contrast to the term "bulk" materials, which refers to macroscopic scale materials, i.e., materials having all dimensions greater than or equal to 1 micron. A "nanoparticle" is defined herein as a particle having nano-scaled dimensions in three dimensions. As used herein, the phrase "silver nanoparticles" is defined to include nanoparticles of pure silver metal, as wells as nanocomposites of pure silver metal coated or capped by elements or compounds extracted from red sand or otherwise agglomerated into nanoparticles or incorporating red sand extracts into the crystalline structure of the silver nanoparticles, as evidenced by EDX analysis.

Sand is a granular material composed of finely divided rock and mineral particles. It is defined by size, being finer than gravel and coarser than silt. Sand is typically a source of magnesium, silica (silicon dioxide, SiO2), calcium carbonate and other elements (such as Co, Ni, Sc, R, V, Cr and Ti).

The present method is illustrated by the following examples.

Example 1

Silver Nanoparticle Synthesis Using Red Sand

For the formation of exemplary silver nanoparticles according to the present method, 145.45 g of red sand, collected from the area in and near Riyadh, Saudi Arabia, was added to 100 ml of distilled water. The red sand in water was allowed to settle, and the supernatant was removed and then centrifuged at 20 rpm for about 2 min. 10 ml of sodium hydroxide (2 g) was added to 40 ml of the supernatant to form an alkaline solution and stirred at 110 rpm at a temperature of 45° C. 20 mg of silver nitrate ($AgNO_3$) was dissolved in 20 ml of distilled water, and the silver nitrate solution was added dropwise to the alkaline solution. The reaction of silver ions from aqueous silver nitrate in the solution forming silver nanoparticles was monitored visually and deemed to have occurred upon a change of color to brown, at which point the precipitated reaction product, including the exemplary silver nanoparticles, was isolated by centrifugation and dried at 35° C.

Example 2

Exemplary Silver Nanoparticle Characterization

The exemplary silver nanoparticles were characterized by dynamic light scattering (DLS) (FIG. 1). DLS results shown in FIG. 1 reflect an average size of the silver nanoparticles, which was found to be 121.6 nm, and the polydispersity index (PDI) was 0.3. The PDI of 0.3 probably reflects a significantly mono-dispersed size population of nanoparticles.

Figure 2A:
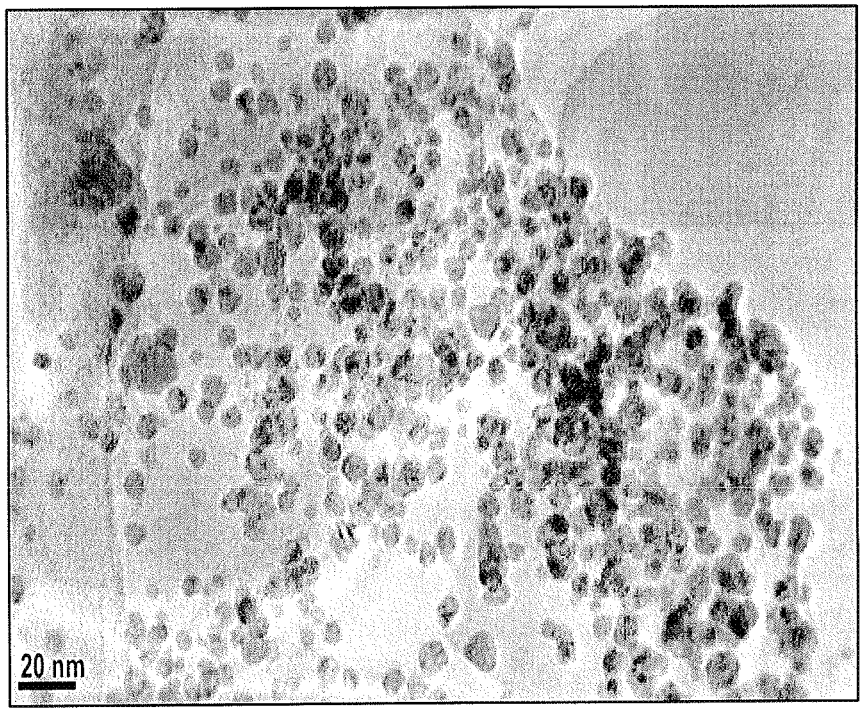
FIGS. 2A, 2B, and 2C are Transmission Electron Microscopy (TEM) micrographs of silver nanoparticles produced according to the method of producing silver nanoparticles using red sand at a magnification of 300000×.
Figure 2B:
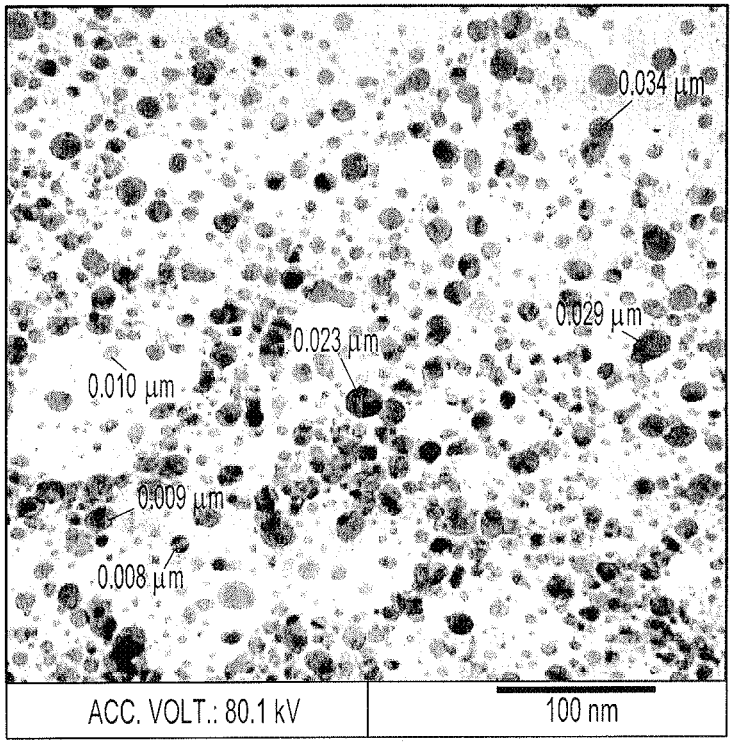
Figure 2C:
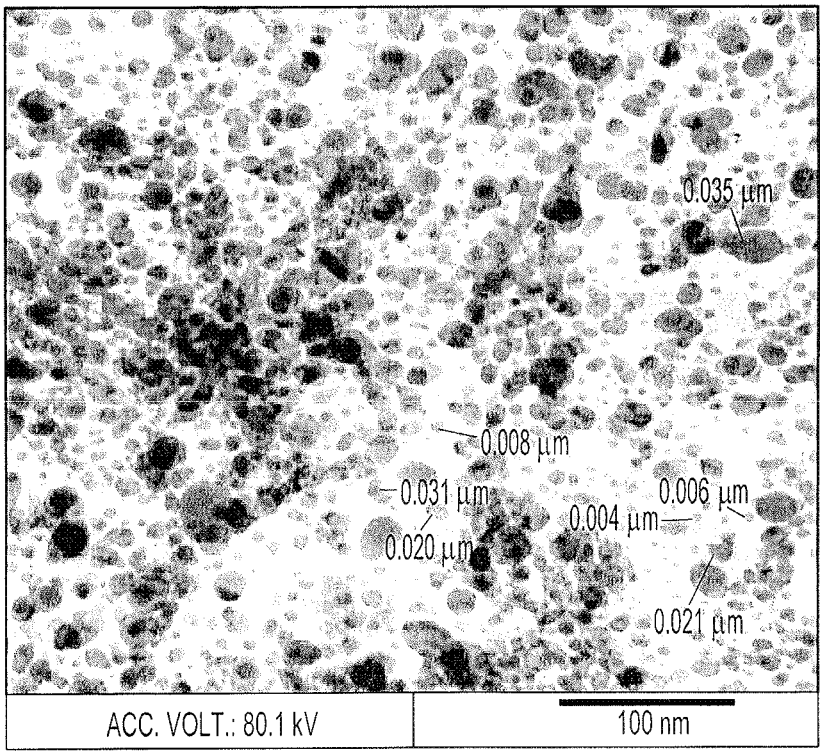

Transmission electron microscopy (TEM) was used to further identify the size, shape and morphology of the exemplary silver nanoparticles. The exemplary silver nanoparticles are well dispersed (not significantly aggregated) and primarily spherical in shape (FIGS. 2A, 2B, 2C).

Figure 3:
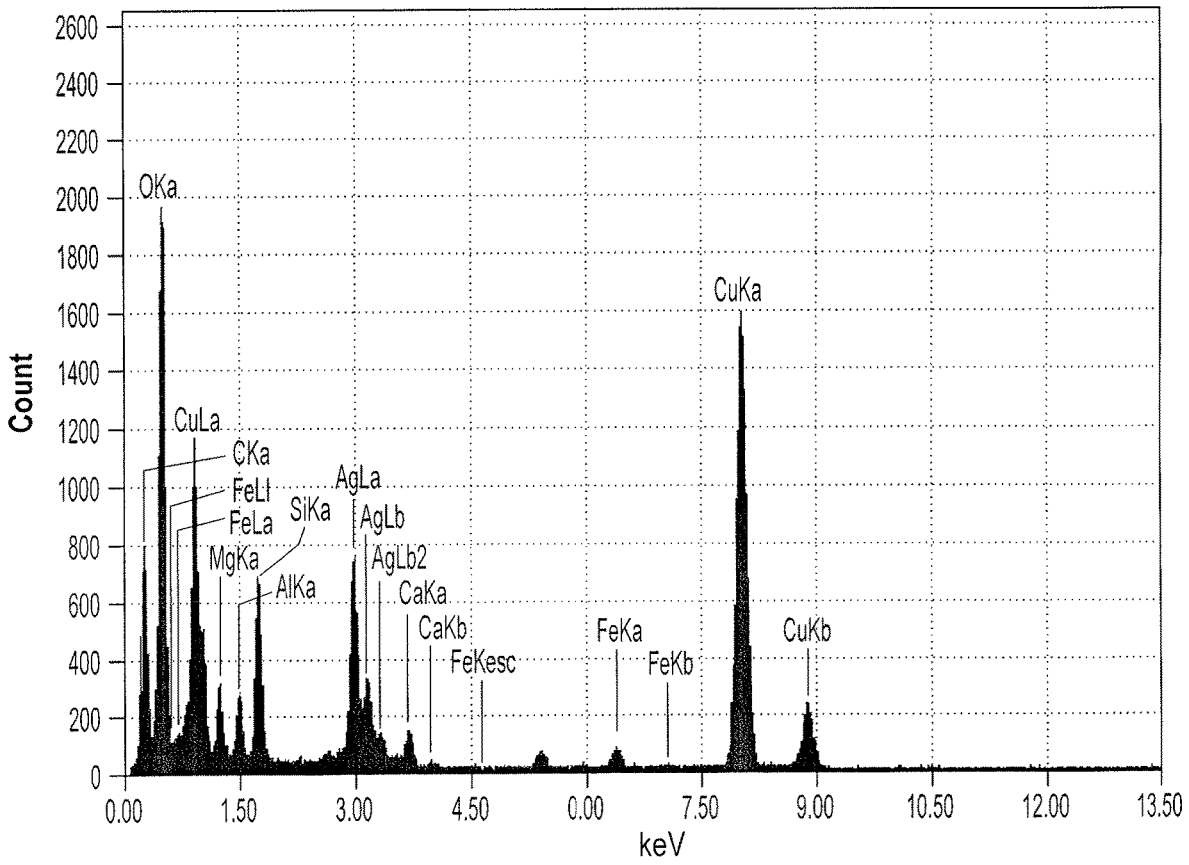
FIG. 3 is an Energy Dispersive X-Ray Spectroscopy (EDX) spectrum of the elemental content in the silver nanoparticles produced according to the method of producing silver nanoparticles using red sand.

Energy dispersive x-ray analysis (EDX) confirmed the formation of silver nanoparticles and further showed the elemental composition of the exemplary silver nanoparticles. FIG. 3 shows peaks corresponding to silver at 3 KeV, copper in the range of 7.5-9.0 KeV and carbon, presumably arising to the components of the grid used for analysis. Elements of iron, magnesium, aluminum, silica, and calcium were also observed, and are likely components of the red sand used in the present method.

Figure 4:
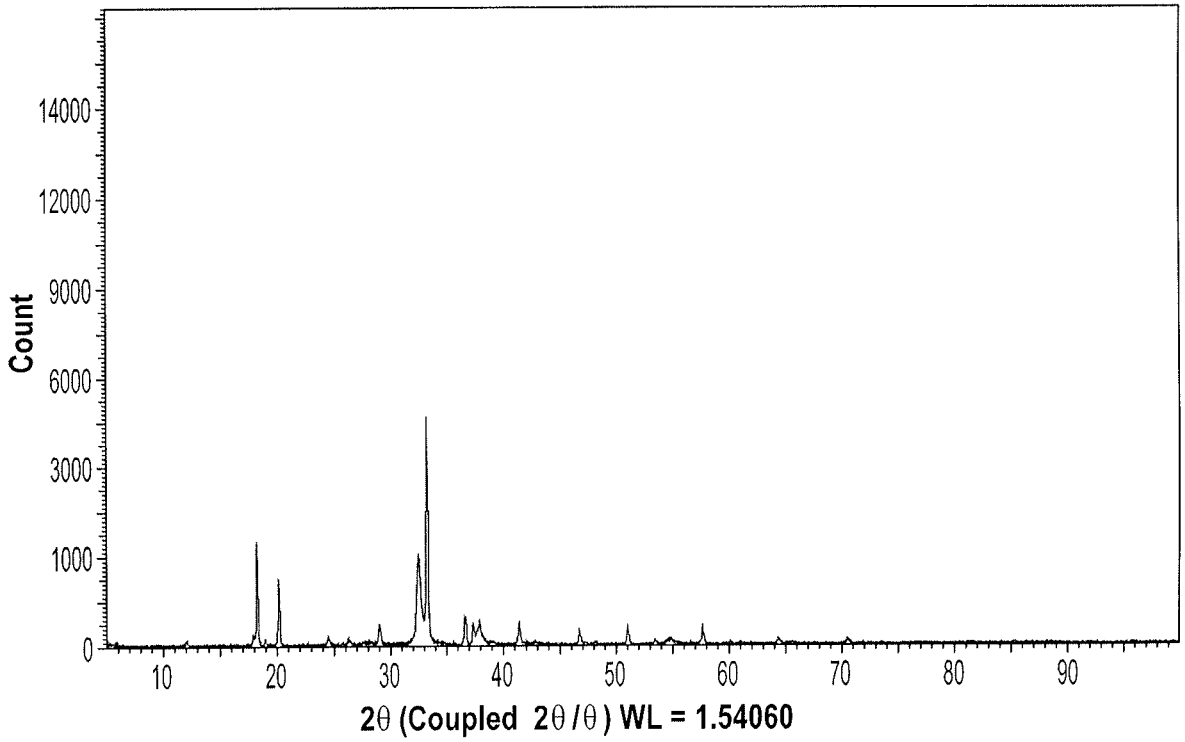
FIG. 4 is a diffractogram showing the X-Ray Dispersive pattern of the silver nanoparticles prepared according to the method of producing silver nanoparticles using red sand.

In FIG. 4, X-ray diffraction analysis (XRD) results reflect the crystalline structure of the exemplary silver nanoparticles. The XRD 2θ spectrum ranging from 10° to 90° shows peak values at 32.5°, 38°, 46°, 55.5°, 58°, 64°, confirming the presence of silver.

Example 3

Antimicrobial Activity of Exemplary Silver Nanoparticles

Antibacterial activity of the exemplary silver nanoparticles, prepared as described above (except that centrifuging and drying were omitted, i.e., antimicrobial testing was performed without removing the silver nanoparticles from the red sand extract), was evaluated against pathogenic bacterial reference strains of *Acinetobacter baumannii* (ATCC 19606), *Salmonella typhimurium* (ATCC 14028), *Escherichia coli* (ATCC 35218), *Pseudomonas aeruginosa* (27853 AT), *Staphylococcus aureus* (25923 AT) and *Proteus vulgaris* (ATCC 49132) using an agar well diffusion assay. In particular, the antibacterial activity against each strain was determined by measuring the inhibition zone. Standard antibiotic discs, including Gentamycin (CN10 μg), Augmantin (AMC 30 μg), and Ciprofloxacin (CIP 5 μg), were used as controls.

Figure 5:
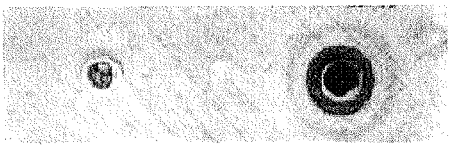
FIG. 5 is a series of photographs showing inhibition zones of various bacteria due to antibacterial activity of silver nanoparticles prepared according to the method of producing silver nanoparticles using red sand.
Figure 5:
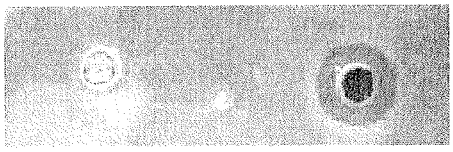
Figure 5:
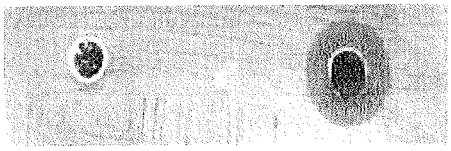
Figure 5:
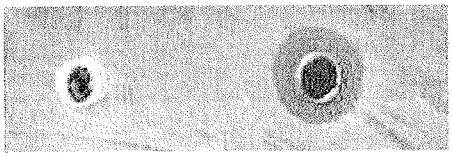
Figure 5:
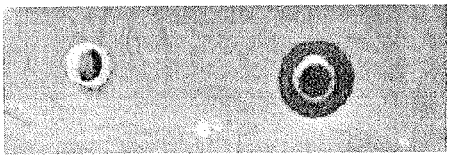
Figure 5:
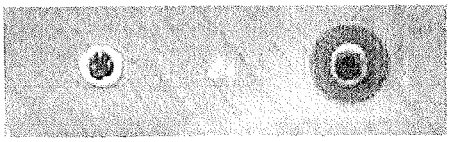
Figure 6:
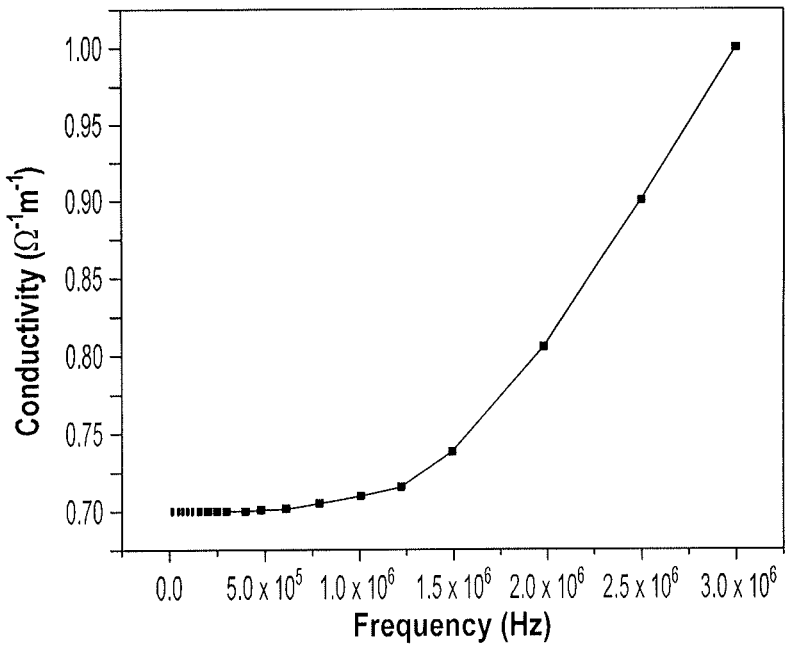
FIG. 6 is a plot of the electrical conductivity of silver nanoparticles prepared according to the method of producing silver nanoparticles using red sand as a function of applied frequency.
Figure 7:
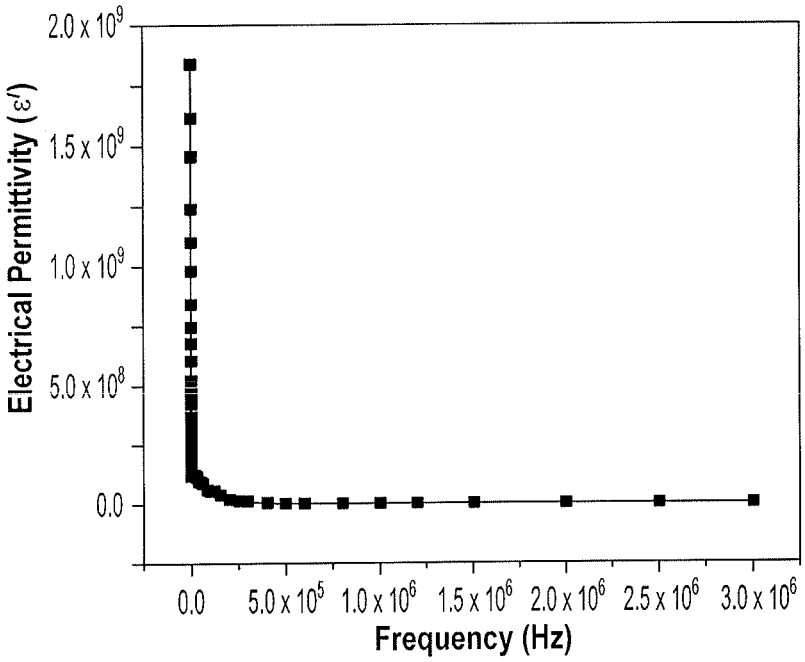
FIG. 7 is a plot of the relative permittivity ε' of silver nanoparticles prepared according to the method of producing silver nanoparticles using red sand as a function of applied frequency.

The exemplary silver nanoparticles showed antibacterial activity against the studied most common human pathogenic bacteria with varying degrees. The activity was indicated by the diameter of inhibition zone. The red sand extract alone (i.e., prepared without addition of silver nitrate) did not show antibacterial activity. The exemplary silver nanoparticles showed the largest inhibition zone (14 mm) against the tested bacterial strain of *Escherichia coli*, followed by *Pseudomonas aeruginosa, Salmonella typhimurium, Proteus vulgari, Acinetobacter baumannii* and *Staphylococcus aureus*, with zones of inhibition of 13.5 mm, 13 mm, 12 mm, 11 mm and 9.5 mm, as shown in Table 1 and FIG. 5.

TABLE 1

Antibacterial activity of silver nanoparticles against human pathogenic bacteria

| | Diameter of inhibition zone (mm) | | |
|---|---|---|---|
| Bacteria strain | Red sand solution | Silver Nanoparticles | Standard antibiotic disc (disc size - mm) |
| *S. aureus* | 0 | 9.5 ± 2 | CN (10) = 30 |
| *P. vulgaris* | 0 | 12 ± 0.0 | AMC (30) = 32 |
| *A. baumannii* | 0 | 11 ± 0.0 | CIP (5) = 25 |

TABLE 1-continued

| Antibacterial activity of silver nanoparticles against human pathogenic bacteria | | | |
|---|---|---|---|
| Diameter of inhibition zone (mm) | | | |
| Bacteria strain | Red sand solution | Silver Nanoparticles | Standard antibiotic disc (disc size - mm) |
| *S. typhimurium* | 0 | 13 ± 0.0 | CN (10) = 24 |
| *P. aeruginosa* | 0 | 13.5 ± 0.7 | CIP (5) = 31 |
| *E. colt* | 0 | 14 ± 0.0 | CIP (5) = 33 |

*All values represented in the table are average of results of duplicates

Moreover, combination effects were determined by first adjusting the turbidity of the previously mentioned bacterial strains to 0.5 MacFarland standards (108 CFU/mL), and swabbing the strains on Mueller-Hinton agar. Antibiotic discs alone were used as controls, respectively. In particular, the antibiotic discs had standard amounts of Fosfomycin (FOS) (50 μg), Tetracycline (TE) (30 μg), Cefepime (FEP) (30 μg), Moxifloxacin (MXF) (5 μg), Levofloxacin (LEV) (5 μg), Rifampicin (RD) (5 μg), Erythromycin (E) (15 μg), Tobramycin (TOB) (10 μg), and Tigecycline (TGC) (15 μg), respectively. To study the combination effect, 30 μl of the exemplary silver nanoparticles were loaded on the antibiotics discs then placed on the swabbed medium. The plates were incubated for 24 hours at 37° C. The diameters of the inhibition zones were measured and reported in millimeters.

The greatest combination effects of the exemplary silver nanoparticles with antibiotics occurred on *Salmonella typhimurium*, as shown in Table 2. Relative to the results shown in Table 1 showing the effect of the exemplary silver nanoparticles on *S. typhimurium* to be an inhibition zone with diameter 13 mm, the exemplary silver nanoparticles combined with the Fosfomycin (FOS) 50 μg standard resulted in an inhibition zone diameter increased to 25 mm. Overall, the Moxifloxacin (MXF) 5 μg displayed the strongest effect on the tested g-negative bacteria.

It is to be understood that the method of producing silver nanoparticles using red sand is not limited to the embodiments described above, but encompasses any and all embodiments within the scope of the following claims.

We claim:

1. A method of producing silver nanoparticles using red sand, comprising the steps of:

adding red sand to water and mixing to form a mixture, wherein the red sand is from an area in and around Riyadh, Saudi Arabia;

removing a supernatant from the red sand in water mixture after the mixture has settled;

adding sodium hydroxide to the supernatant to form an alkaline solution;

adding silver nitrate (AgNO3) to the alkaline solution; and isolating a precipitated reaction product including the silver nanoparticles, wherein the nanoparticles have an average size between 100-150 nm.

2. The method of producing silver nanoparticles using red sand according to claim 1, further comprising the steps of centrifuging the supernatant and discarding any solid matter separated from the supernatant by the centrifuging prior to the step of adding sodium hydroxide to the supernatant.

3. The method of producing silver nanoparticles using red sand according to claim 1, wherein the step of adding sodium hydroxide is performed under stirring at a temperature of about 45° C.

4. The method of producing silver nanoparticles using red sand according to claim 3, wherein the stirring is performed at 110 rpm for about 30 minutes.

5. The method of producing silver nanoparticles using red sand according to claim 1, wherein the step of adding silver nitrate comprises dissolving silver nitrate in water to form aqueous silver nitrate and adding the aqueous silver nitrate dropwise into the alkaline solution.

6. The method of producing silver nanoparticles using red sand according to claim 1, wherein the step of isolating the

TABLE 2

| Effect of combination of the silver nanoparticles with antibiotics | | | | | | | | | | | | |
|---|---|---|---|---|---|---|---|---|---|---|---|---|
| Against Gram Negative Bacteria | | | | | | | | | | | | |
| Antibiotic | Nitrofurantoin (F) 100 μg | | Fosfomycin (FOS) 50 μg | | Tetracycline (TE) 30 μg | | Cefepime (FEP) 30 μg | | Moxifloxacin (MXF) 5 μg | | Levofloxacin (LEV) 5 μg | |
| Bacteria | C | Np | C | Np | C | Np | C | Np | C | Np | C | Np |
| *S. typhimurium* | 23.5 | 19.5 | 20.5 | 25 | 18 | 20 | 23.5 | 10 | 30 | 31 | 30 | 32.5 |
| *E. coli* | 21.5 | 10 | 24 | 15 | 17 | 10 | — | 9 | 31 | 32 | 35 | 34.5 |
| *A. baumannii* | 11 | 10.5 | 10 | 9.5 | 11.5 | 13.5 | — | 9.5 | 20 | 20 | 23 | 26 |
| *P. aeruginosa* | — | 14 | 27 | 21.5 | 11.5 | 8 | 11 | 8 | 22.5 | 19.5 | 27 | 22.5 |
| *P. vulgaris* | 10 | 8 | 11 | 8.5 | 11. | 12.5 | — | 8. | 19. | 27 | 33 | 33.5 |
| Against Gram Positive Bacteria | | | | | | | | | | | | |
| Antibiotic | Rifampicin (RD) 5 μg | | Erythromycin (E) 15 μg | | Tobramycin (TOB) 10 μg | | Tigecycline (TGC) 15 μg | | Moxifloxacin (MXF) 5 μg | | Levofloxacin (LEV) 5 μg | |
| Bacteria | C | Np | C | Np | C | Np | C | Np | C | Np | C | Np |
| *S. aureus* | 34.5 | 29.5 | 32 | 28 | 26 | 31.5 | 24 | 24 | 33 | 34 | 27 | 30 |

Mean zone of inhibition in mm ± standard deviation

C: The inhibition zone of the antibiotic alone as a control.

Np: The inhibition zone of silver nanoparticles combined with antibiotics precipitated reaction product is performed after the alkaline solution with aqueous silver nitrate added visually changes color to brown.

* * * * *